US010753154B1

(12) United States Patent
Kolle et al.

(10) Patent No.: US 10,753,154 B1
(45) Date of Patent: Aug. 25, 2020

(54) EXTENDED REACH FLUIDIC OSCILLATOR

(71) Applicant: TEMPRESS TECHNOLOGIES, INC., Renton, WA (US)

(72) Inventors: Jack J Kolle, Seattle, WA (US); Scott A Fletcher, Seattle, WA (US); Andrew W Fraser, Seattle, WA (US)

(73) Assignee: Tempress Technologies, Inc., Renton, WA (US)

( * ) Notice: Subject to any disclaimer, the term of this patent is extended or adjusted under 35 U.S.C. 154(b) by 0 days.

(21) Appl. No.: 16/655,463

(22) Filed: Oct. 17, 2019

(51) Int. Cl.

| | |
|---|---|
| ***E21B 7/24*** | (2006.01) |
| ***E21B 23/04*** | (2006.01) |
| ***E21B 28/00*** | (2006.01) |
| ***E21B 41/00*** | (2006.01) |
| ***B05B 1/08*** | (2006.01) |
| *F15D 1/00* | (2006.01) |

(52) U.S. Cl.
CPC ..... *E21B 7/24* (2013.01); *B05B 1/08* (2013.01); *E21B 23/04* (2013.01); *E21B 28/00* (2013.01); *E21B 41/0078* (2013.01); *F15D 1/0015* (2013.01)

(58) Field of Classification Search
CPC . E21B 7/24; E21B 23/04; E21B 28/00; E21B 41/0078; B05B 1/08
See application file for complete search history.

(56) References Cited

U.S. PATENT DOCUMENTS

| | | | | |
|---|---|---|---|---|
| 3,158,166 | A | 11/1964 | Warren | |
| 3,180,575 | A | 4/1965 | Warren | |
| 3,228,410 | A | 1/1966 | Warren | |
| 3,238,960 | A * | 3/1966 | Hatch, Jr. | F15C 1/22 137/811 |
| 3,320,966 | A | 5/1967 | Swartz | |
| 3,348,562 | A | 10/1967 | Ogren | |
| 3,452,771 | A | 7/1969 | Kirshner et al. | |
| 3,528,442 | A | 9/1970 | Campagnuolo | |
| 3,536,084 | A | 10/1970 | Depperman et al. | |
| 3,638,866 | A | 2/1972 | Walker | |
| 3,926,373 | A | 12/1975 | Viets | |

(Continued)

FOREIGN PATENT DOCUMENTS

| | | |
|---|---|---|
| CN | 106368609 | 2/2017 |
| CZ | 306064 | 7/2016 |

(Continued)

OTHER PUBLICATIONS

V. Tesai; AIA A Journal, vol. 51, No. 2, Feb. 2013 New Fluidic—Oscillator Concept for Flow-Separation Control.

(Continued)

*Primary Examiner* — Matthew R Buck
(74) *Attorney, Agent, or Firm* — Morgan, Lewis & Bockius LLP

(57) ABSTRACT

A fluidic oscillator includes a vortex chamber in fluid communication with a flow volume, an outlet, a first control port, and a second control port. The flow volume is defined by a first wall and a second wall. The first wall and the second wall are arranged to direct a fluid flow to create a vortex flow in the vortex chamber. The pressure differential cycles the attachment of fluid flow between the first wall and the second wall at a cycle rate. Because the fluidic oscillator can operate at a low cycle rate, the fluidic oscillator can provide an extended reach.

28 Claims, 13 Drawing Sheets

(56) References Cited

U.S. PATENT DOCUMENTS

| | | | | |
|---|---|---|---|---|
| 3,942,559 | A | 3/1976 | Kranz et al. | |
| 4,052,002 | A * | 10/1977 | Stouffer | A61C 17/028 239/4 |
| 4,134,100 | A | 1/1979 | Funke | |
| 4,151,955 | A | 5/1979 | Stouffer | |
| 4,227,550 | A | 10/1980 | Bauer et al. | |
| 4,231,519 | A | 11/1980 | Bauer | |
| 4,291,395 | A | 9/1981 | Holmes | |
| 4,943,007 | A | 7/1990 | Bowe et al. | |
| RE33,605 | E | 6/1991 | Bauer | |
| 5,135,051 | A | 8/1992 | Facteau et al. | |
| 5,165,438 | A | 11/1992 | Facteau et al. | |
| 5,228,508 | A | 7/1993 | Facteau et al. | |
| 5,893,383 | A | 4/1999 | Facteau | |
| 6,408,866 | B1 | 6/2002 | Carver et al. | |
| 7,128,082 | B1 | 10/2006 | Cerretelli et al. | |
| 7,735,749 | B2 | 6/2010 | Tibbetts | |
| 7,909,094 | B2 | 3/2011 | Schultz et al. | |
| 8,381,817 | B2 | 2/2013 | Schultz et al. | |
| 8,418,725 | B2 * | 4/2013 | Schultz | E21B 28/00 137/810 |
| 8,424,605 | B1 | 4/2013 | Schultz et al. | |
| 8,517,107 | B2 | 8/2013 | Schultz et al. | |
| 8,573,066 | B2 | 11/2013 | Schultz et al. | |
| 8,646,483 | B2 * | 2/2014 | Schultz | E21B 28/00 137/835 |
| 8,863,835 | B2 * | 10/2014 | Schultz | E21B 28/00 166/244.1 |
| 8,944,160 | B2 | 2/2015 | Surjaatmadja et al. | |
| 9,120,563 | B2 | 9/2015 | Raghu | |
| 9,212,522 | B2 | 12/2015 | Schultz et al. | |
| 9,316,065 | B1 | 4/2016 | Schultz et al. | |
| 9,328,587 | B2 | 5/2016 | Surjaatmadja et al. | |
| 9,718,538 | B2 | 8/2017 | Avraham et al. | |
| 9,897,118 | B2 | 2/2018 | Raghu | |
| 9,915,107 | B1 | 3/2018 | Schultz et al. | |
| 10,041,347 | B2 | 8/2018 | Murphree et al. | |
| 10,144,394 | B1 | 12/2018 | Rice | |
| 10,294,782 | B2 | 5/2019 | Murphree et al. | |
| 10,301,905 | B1 | 5/2019 | Schultz et al. | |
| 10,513,900 | B1 * | 12/2019 | Schultz | E21B 4/02 |
| 2008/0121295 | A1 | 5/2008 | Tippetts | |
| 2011/0122727 | A1 | 5/2011 | Gleitmzn et al. | |
| 2012/0291539 | A1 | 11/2012 | Schultz et al. | |
| 2013/0048274 | A1 | 2/2013 | Schultz | |
| 2018/0318848 | A1 | 11/2018 | Bobusch et al. | |
| 2019/0153798 | A1 | 5/2019 | Zhang et al. | |

FOREIGN PATENT DOCUMENTS

| | | |
|---|---|---|
| EP | 0304988 | 8/1988 |
| EP | 1195862 | 2/2004 |
| EP | 1086315 | 4/2004 |
| EP | 1851447 | 11/2007 |
| EP | 1760262 | 4/2008 |
| EP | 2176511 | 4/2010 |
| EP | 2176516 | 4/2010 |
| EP | 2722274 | 5/2019 |
| WO | 2013028402 | 2/2013 |
| WO | 2019020516 | 1/2019 |
| WO | 2019103896 | 5/2019 |
| WO | 2019108628 | 6/2019 |
| WO | 2019122159 | 6/2019 |

OTHER PUBLICATIONS

Jeong; Shape Optimization of a feedback-channel fluidic oscillator; Oct. 9, 2017; https://www.tandfonline.com/doi/pdf/10.1080/199420602017.1379441.

PCT, International Search Report and Written Opinion; PCT/US19/56662, dated Jan. 16, 2020.

* cited by examiner

EXTENDED REACH FLUIDIC OSCILLATOR

TECHNICAL FIELD

The present disclosure relates generally to fluidic oscillators, and more particularly, to fluidic oscillators with extended reach for use within wellbores.

BACKGROUND

Wells are drilled to facilitate the extraction of hydrocarbons or other resources from a formation. During the life of the well, well intervention operations can be performed, such as removing deposits from near the wellbore or stimulating the formation.

Fluidic oscillators can be used for such well intervention operations. Further, during the drilling and casing of a well, fluidic oscillators can be used to decrease friction experienced by the drill string during drilling. However, one drawback of conventional fluidic oscillators is that conventional fluidic oscillators may operate at high frequencies, high differential pressure, and may not produce sufficiently high pressure pulse amplitude. During operation, the pressure pulses created by conventional fluidic oscillators may not effectively travel long distances, limiting the range of effectiveness of conventional fluidic oscillators.

Examples of conventional fluidic oscillators include those disclosed in U.S. Pat. Nos. 8,418,725, 8,646,483, and 8,863,835. However, in each of these devices, a structure is located within the central flow chamber, thus dividing the chamber into two discrete and physically separated channels. This configuration leads to higher frequency oscillations, which may be undesirable for the reasons explained above.

Additionally, in some applications, conventional fluidic oscillators can require relatively high pressure differentials to operate.

Therefore, what is needed is an apparatus, system or method that addresses one or more of the foregoing issues, among one or more other issues.

SUMMARY OF THE INVENTION

A fluidic oscillator is disclosed. The fluidic oscillator includes a vortex chamber in fluid communication with a flow volume, an outlet, a first control port, and a second control port. The flow volume is defined by a first wall and a second wall. The first wall and the second wall are arranged to direct a fluid flow to create a vortex flow in the vortex chamber. Further, the first control port and the second control port are each disposed tangentially to the fluid flow within the vortex chamber. The fluid flow creates a pressure differential across the first control port and the second control port. The pressure differential cycles the attachment of fluid flow between the first wall and the second wall at a cycle rate. Because the fluidic oscillator can operate at a reduced cycle rate compared to conventional fluidic oscillators while providing high amplitude pulses the fluidic oscillator can provide greater extended reach.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
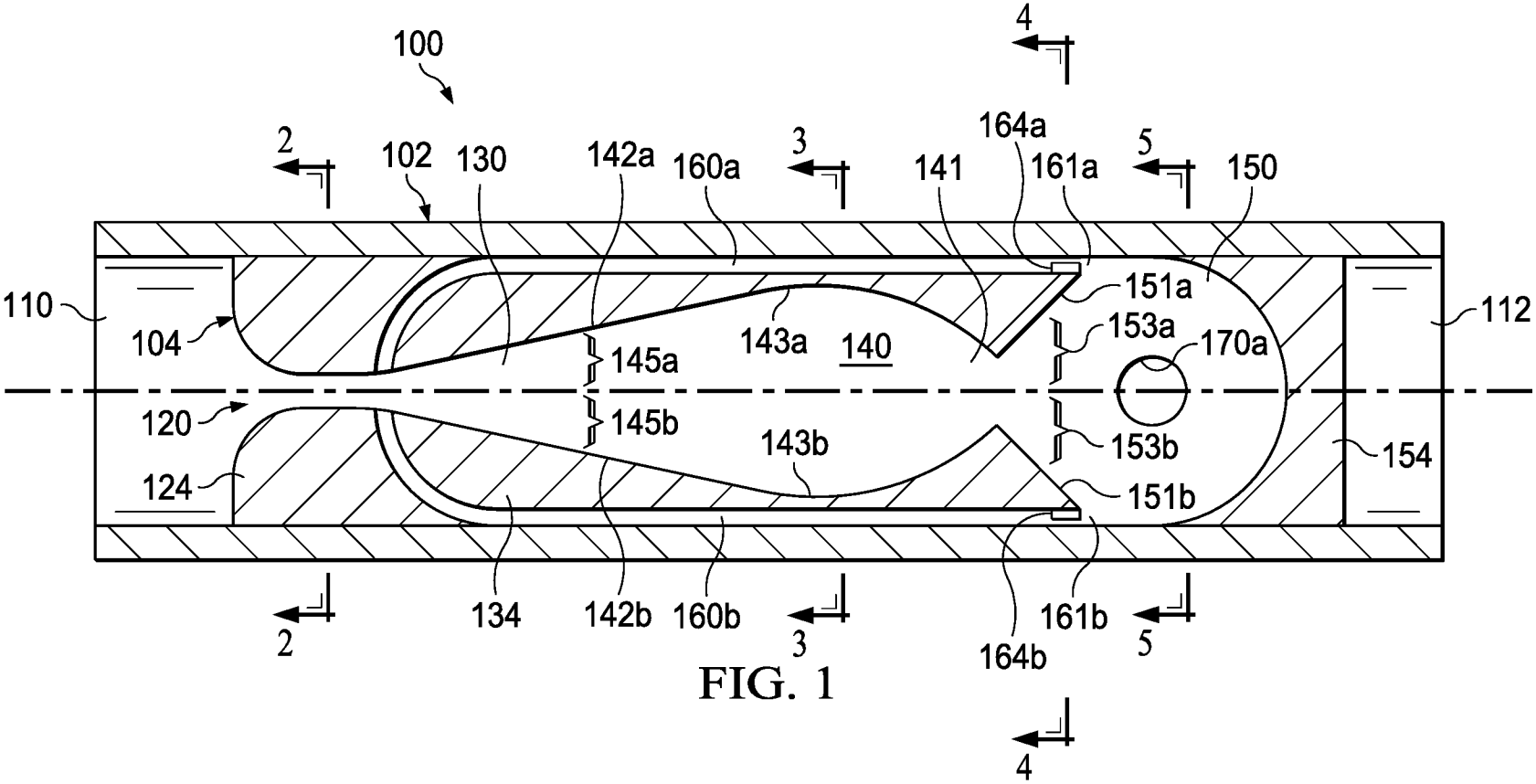
FIG. 1 is cross-sectional view of a fluidic oscillator.

FIG. 1 is cross-sectional view of a fluidic oscillator 100. In the depicted example, the fluidic oscillator 100 can create fluidic pulses and/or axial vibrations from a constant flow of fluid passing therethrough. As described herein, the fluidic oscillator 100 can provide for lower frequency operation and require lower pressure differentials compared to certain conventional fluidic oscillators.

In the illustrated embodiment, the fluidic oscillator 100 allows for a fluid flow to pass through from an inlet volume 110 to an outlet volume 112. In the depicted example, the fluidic oscillator 100 receives a fluid flow at an inlet volume 110. The inlet volume 110 can be defined by a portion of the housing 102. In some embodiments, the inlet volume 110 is in fluid communication with a fluid supply tube such as a length of coiled tubing or jointed tube inserted into a wellbore and connected to supply pumps on surface. In some embodiments, the fluid flow is a constant flow rate of fluid supplied by a fixed displacement pump and can include any suitable fluid, including water. Optionally, the fluid flow can include a friction reducing polymer, such as Xanthan gum, polyacrylamide and/or polyethylene oxide.

As described herein, the fluid flow from the inlet volume 110 passes through the housing 102 and an insert 104 disposed therein. After passing through the housing 102 and the insert 104, the fluid flow can be directed toward the outlet volume 112. Optionally, the outlet volume 112 can be in fluid communication with an outlet tube, motors and/or jet nozzles.

In the illustrated embodiment, the fluid flow passing through the housing 102 and an insert 104 disposed therein can generate fluidic pulses. In some embodiments, flow areas or features described herein are defined within the insert 104 or cooperatively between the housing 102 and the insert 104. In some embodiments, the insert 104 can be formed from one or more portions to facilitate assembly. Optionally, the insert 104 is formed from an upper half and a lower half.

Figure 2:
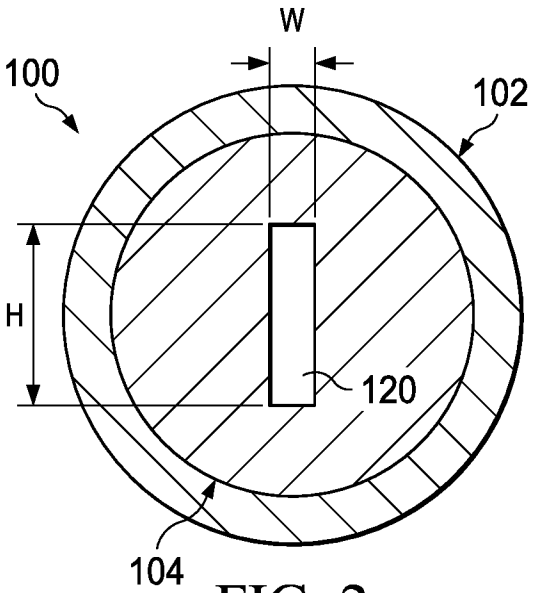
FIG. 2 is a cross-sectional view of the fluidic oscillator of FIG. 1 at section line 2-2.

FIG. 2 is a cross-sectional view of the fluidic oscillator of FIG. 1 at section line 2-2. With reference to FIGS. 1 and 2, fluid flow is directed into the insert 104 through a nozzle 120. In some embodiments, the nozzle 120 can have a generally converging cross-section or geometry to accelerate the fluid flow through the nozzle 120. In some embodiments, the nozzle 120 has a generally "flat" or rectangular cross-sectional profile in order to form a "flat" jet, with a height h to width w ratio of 4:1 as shown in FIG. 2. In some embodiments, the nozzle 120 can have a height h to width w ratio as high as 6:1 or as low as 2:1, however any ratio in between these values, including non-integer ratios, may also be used. As can be appreciated, features of the nozzle 120 can be defined by a nozzle insert portion 124.

During operation, the nozzle 120 accelerates fluid flow into a switch volume 130 defined by an upper wall 142*a* and a lower wall 142*b*. The angle 145*a* between the upper wall 142*a* and the centerline of the device and/or the angle 145*b* between the lower wall 142*b* and the centerline of the device can be in the range of 10 to 60 degrees. The upper and lower wall angles 145*a*, 145*b* may be different. For example, the upper wall angle 145*a* can be 12 degrees and the lower wall angle 145*b* can be 20 degrees. Due to the Coanda effect, the flat jet issuing from nozzle 120 will attach to either the upper or lower wall 142*a* or 142*b* of the insert portion 134 defining the switch volume 130.

Figure 3:
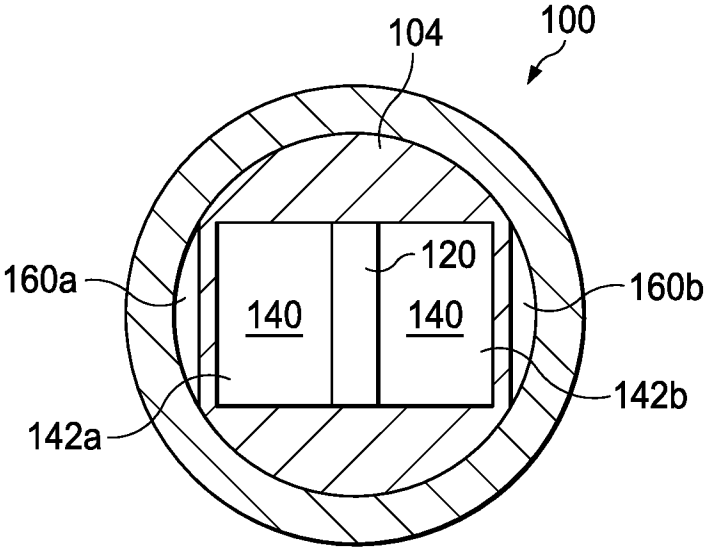
FIG. 3 is a cross-sectional view of the fluidic oscillator of FIG. 1 at section line 3-3.

FIG. 3 is a cross-sectional view of the fluidic oscillator of FIG. 1 at section line 3-3. With reference to FIGS. 1 and 3, fluid flow attached to the walls of the switch-volume 130 will attach to an upper wall 142*a* or a lower wall 142*b* of a flow volume 140. Contrary to many existing fluidic oscillators, flow volume 140 does not include a structure dividing the volume into two discrete and physically separated channels. It has been determined that this configuration is particularly effective in reducing the frequency at which the fluidic oscillator 100 will operate.

The geometry of the flow volume 140 can facilitate direction of fluid flow along the upper wall 142*a* or the lower wall 142*b* without a separation body or otherwise defining channels within the flow volume 140. As discussed above, the initial portions of the walls 142*a* and 142*b* are inclined at an included angle 145*a* and 145*b* of 10 to 30 degrees. In some embodiments, the distal wall portions 143*a* and 143*b* can be convex with a smooth curved profile to prevent the wall jet from separating and dissipating. Fluid flow within the flow volume 140, including flow along the upper wall 142*a* and/or the lower wall 142*b* is directed into a vortex chamber 150 through inlet 141.

As can be appreciated, and as described herein, the geometry of the flow volume 140, including the upper wall 142*a* and/or the lower wall 142*b* can affect the fluid flow to the vortex chamber 150 and can be adjusted or altered to control the behavior and response of the fluidic oscillator 100. In the depicted example, the insert portion 134 can define the shape of the flow volume 140 and flow path along the upper wall 142*a* and/or the lower wall 142*b*. Advantageously, it has been recognized that the wall jet that is attached to the upper wall 142*a* and/or the lower wall 142*b* remains stable and maintains its velocity for a relatively long distance. Computational fluid dynamics analysis and experiments have shown that these wall jets are stable for at least 20 times the width w of the inlet nozzle 120. Optionally, this stability is further enhanced by the use of friction reducing polymers.

In some embodiments, the upper wall 142*a* and/or the lower wall 142*b* can be defined to have a generally curved or concave path, increasing the flow length along the upper wall 142*a* and/or the lower wall 142*b*. The concave geometry of the upper wall 142*a* and/or the lower wall 142*b* can introduce angular momentum to the wall jet, which further increases its stability. As can be appreciated, while the flow paths may generally converge or cross over, the upper wall 142*a* and/or the lower wall 142*b* can maintain attached wall jets entering the vortex chamber 150.

In the depicted example, flow from the flow volume 140 is introduced into the vortex chamber 150 by a single flow inlet 141. As illustrated, the upper distal wall 143*a* and the lower distal wall 143*b* of the flow volume 140 can be arranged relative to the flow inlet 141 and/or the vortex chamber 150, directing flow to create a vortex or vortical flow within the vortex chamber 150. In some embodiments, portions (e. g. outlet portions) of the upper distal wall 143*a* and/or the lower distal wall 143*b* can be arranged to be tangential to a vortex flow or an intended vortex flow within the vortex chamber 150.

For example, the outlet portion of the upper distal wall 143*a* can be arranged or disposed to be tangential to and to create a counter-clockwise rotating vortex flow formed within the vortex chamber 150. Similarly, the outlet portion of the lower distal wall 143*b* can be arranged or disposed to be tangential to and to create a clockwise rotating vortex flow formed within the vortex chamber 150. In some embodiments, the upper distal wall 143*a* and/or the lower distal wall 143*b* can be disposed tangential to surfaces, such as an upper and lower chamber surfaces or walls 151*a* and 151*b*, of the vortex chamber 150. As can be appreciated, the vortex chamber 150 can include geometry to induce or facilitate vortex flow from the flow provided by the flow inlet 141. For example, the width of the inlet 141 can be configured to accommodate a wall jet that is 1.4 times the width w of the nozzle 120, 2 times the width w of the nozzle 120, or other ranges of available ratios, as would be understood by those of skill in the art. Further, the chamber walls 151*a* and 151*b* can be disposed at angles 153*a* and 153*b*, respectively, relative to the centerline of the device. In some embodiments, the chamber walls 151*a* and 151*b* can be disposed at 45 degree angles 153*a* and 153*b*. In some embodiments, the vortex chamber 150 can include a semi-circular chamber insert portion 154.

Figure 5:
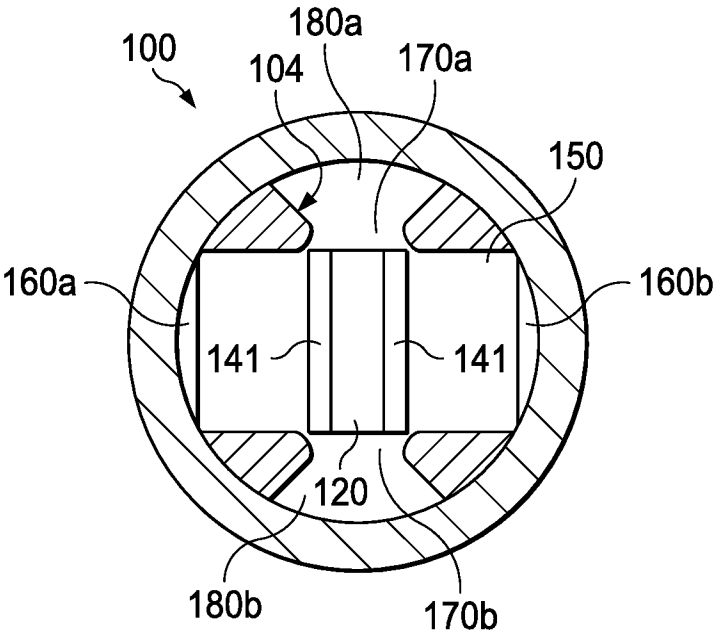
FIG. 5 is a cross-sectional view of the fluidic oscillator of FIG. 1 at section line 5-5.
Figure 4:
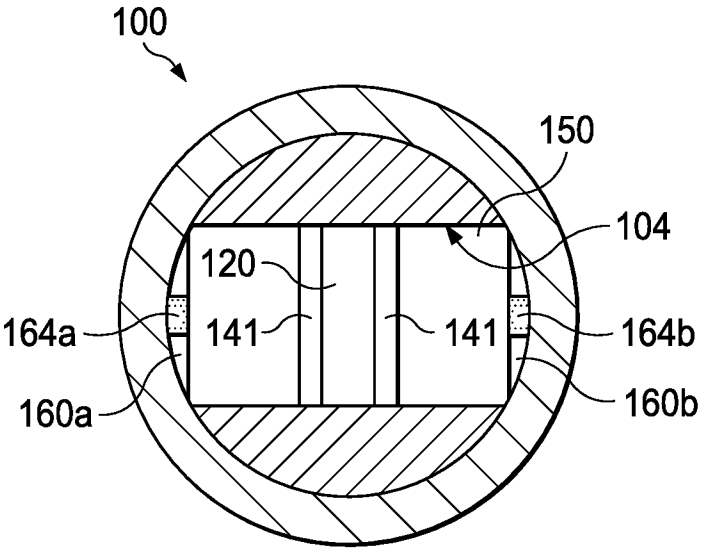
FIG. 4 is a cross-sectional view of the fluidic oscillator of FIG. 1 at section line 4-4.

FIG. 5 is a cross-sectional view of the fluidic oscillator of FIG. 1 at section line 5-5. With reference to FIGS. 1 and 5, vortex flow formed within the vortex chamber 150 can exit the vortex chamber 150 and flow toward the outlet volume 112 through one or more axial ports 170*a* and 170*b*. In some embodiments, fluid flow from the axial ports 170*a* and 170*b* can be directed toward the outlet volume 112 through outlet channels 180*a* and 180*b*.

In some embodiments, fluid flow through the vortex chamber 150 can accelerate to flow through the axial ports 170*a* and 170*b*, creating a strong pressure gradient. As can be appreciated, pressure may be inversely proportional to the square of the diameter of the axial ports 170*a* and 170*b*. Therefore, in some embodiments, the diameter of the axial ports 170*a* and 170*b* can be altered or adjusted to control the pressure gradient created by the fluidic oscillator 100. For example, the axial ports 170*a* and 170*b* can have a diameter that is ⅓ to 1/10 of the diameter of the vortex chamber 150.

In the depicted example, an upper control line 160*a* and/or a lower control line 160*b* can control the rotation and direction of fluid flow through the vortex chamber 150. For example, the use of the upper control line 160*a* and/or the lower control line 160*b* can control whether the flow introduced into the vortex chamber 150 from the flow volume 140 is attached to the upper wall 142*a* and/or the lower wall 142*b*. As can be appreciated, by controlling the attachment of flow of the upper wall 142*a* and the lower wall 142*b*, the upper control line 160*a* and/or the lower control line 160*b* can control the rotational direction of the vortex flow within the vortex chamber 150 and the oscillation and/or cycling of the rotational direction of the vortex flow, allowing the fluidic oscillator 100 to oscillate and create pressure pulses.

As illustrated, an upper control port 161*a* and a lower control port 161*b* are disposed within or are otherwise in fluid communication with the vortex chamber 150. The upper control port 161*a* is in fluid communication with the upper control line 160*a* and the lower control port 161*b* is in fluid communication with the lower control line 160*b*. During operation, the upper control port 161*a* and the lower control port 161*b* can be in fluid communication with the vortex flow within the vortex chamber 150.

In some embodiments, the vortex flow can enter or flow across the upper control port 161*a* and/or the lower control port 161*b*, creating a pressure differential across the upper control port 161*a* and/or the lower control port 161*b*. For example, in some embodiments, vortex flow may impinge the upper control port 161*a* and/or the lower control port 161*b*.

In the depicted example, the upper control port 161*a* and the lower control port 161*b* can be disposed tangentially to the vortex flow or an intended vortex flow within the vortex chamber 150. Optionally, the upper control port 161*a* and/or the lower control port 161*b* can be disposed tangential to surfaces, such as the upper chamber wall 151, of the vortex chamber 150. By disposing the upper control port 161*a* and the lower control port 161*b* tangentially to the vortex flow, vortex flow may impinge one of the control ports, while flowing across the other control port, creating or increasing the pressure differential between the upper control port 161*a* and the lower control port 161*b*.

For example, if a counter-clockwise rotating vortex flow is formed in the vortex chamber 150 (e. g. by directing flow along the upper wall 142*a*), the counter-clockwise rotating vortex flow may impinge upon the upper control port 161*a* and may tangentially flow across the lower control port 161*b*. Flow impinging upon the upper control port 161*a* can increase pressure within the upper control line 160*a*, while flow across the lower control port 161*b* can decrease pressure within the lower control line 160*b*, creating a positive pressure differential between the upper control line 160*a* and the lower control line 160*b*.

Similarly, if a clockwise rotating vortex flow is formed in the vortex chamber 150 (e. g. by directing flow along the lower wall 142*b*), the clockwise rotating vortex flow may impinge upon the lower control port 161*b* and may tangentially flow across the upper control port 161*a*. Flow impinging upon the lower control port 161*b* can increase pressure within the lower control line 160*b*, while flow across the upper control port 161*a* can decrease pressure within the upper control line 160*a*, creating a negative pressure differential between the upper control line 160*a* and the lower control line 160*b*.

With reference to FIGS. 1 and 3, the upper control line 160*a* and/or the lower control line 160*b* can extend between the vortex chamber 150 and the switch volume 130 to communicate the pressure differential between the upper control line 160*a* and lower control line 160*b*. In some embodiments, the upper control line 160*a* and/or the lower control line 160*b* can include geometry or features that affect the fluid flow or pressure differential therein. As can be appreciated, geometric features, such as cross-sectional areas of various portions of the upper control line 160*a* and/or the lower control line 160*b* can be adjusted or altered to adjust the oscillation rate or cycle rate of the fluidic oscillator 100. In some embodiments, the upper control line 160*a* and/or the lower control line 160*b* can be defined by features or geometry of the outer surface of the insert portion 134 and/or the inner surface of the housing 102.

During operation, the pressure differential between the upper control line 160*a* and the lower control line 160*b* can direct the fluid flow from the nozzle 120 within the switch volume 130 toward the upper wall 142*a* or the lower wall 142*b*. For example, when a positive pressure differential is created between the upper control line 160*a* and the lower control line 160*b*, the increased pressure from the upper control line 160*a* and the reduced pressure from the lower control line 160*b* can cause the wall jet to detach from upper wall 142*a* and attach to lower wall 142*b*. Similarly, when a negative pressure differential is created between the upper control line 160*a* and the lower control line 160*b*, the increased pressure from the lower control line 160*b* and the reduced pressure from the upper control line 160*a* can cause the wall jet to detach from 142*b* and attach to 142*a*.

Advantageously, the arrangement of the upper control line 160*a* and lower control line 160*b* relative to the nozzle 120, the upper wall 142*a*, and the lower wall 142*b*, allows for the pressure differential to switch, oscillate, or cycle the fluid flow between attaching to the upper wall 142*a* and the lower wall 142*b*. For example, when flow is directed along the upper wall 142*a* a counter-clockwise rotational vortex flow is created in the vortex chamber 150, creating a positive pressure differential across the upper control line 160*a* and the lower control line 160*b*, directing the fluid flow toward the lower wall 142*b*. Similarly, when flow is directed along the lower wall 142*b*, a clockwise rotational vortex flow is created in the vortex chamber 150, creating a negative pressure differential across the upper control line 160*a* and the lower control line 160*b*, cycling the fluid flow back toward the upper wall 142*a*. In transition, as the fluid flow switches between attaching to the upper wall 142*a* and the lower wall 142*b*, the vortex flow within the vortex chamber 150 weakens, dropping the pressure differential, allowing the fluidic oscillator 100 to cycle at a relatively constant rate.

FIG. 5 is a cross-sectional view of the fluidic oscillator of FIG. 1 at section line 5-5. With reference to FIGS. 1 and 5, the control lines 160*a* and 160*b* can include one or more restrictors 164*a* and 164*b*, respectively, to reduce the cycle rate of pressure oscillations and to increase the pressure differential needed to induce switching. As illustrated, the restrictors 164*a* and 164*b* can be disposed adjacent to the control ports 161*a* and 161*b* and/or the vortex chamber 150. In some embodiments, the restrictors 164*a* and 164*b* can be disposed adjacent to the switch volume 130 and opposite to the vortex chamber 150. In some embodiments, the restrictors 164*a* and 164*b* are formed as central bodies so that the control flow originates from the sides of the vortex chamber 150. This configuration forces the pulse amplitude to increase before the flow switches. Advantageously, this configuration can result in higher amplitude pulses and lower frequency operation. In some embodiments, the restrictors 164*a* and 164*b* extend into the control lines 160*a* and 160*b* to reduce the cross-sectional area of the control lines 160*a* and 160*b* by 90%, 80%, 75%, 50%, etc. compared to the remainder of the control lines 160*a* and 160*b*, respectively. The restrictors 164*a* and 164*b* can have a generally rectangular cross-sectional profile, semi-circular cross-section profile, and/or a polygonal cross-sectional profile. As can be appreciated, restrictors 164*a* and 164*b* can have similar or different geometric features.

In some embodiments, the geometry of the control lines 160*a* and 160*b*, including the geometry of the restrictors

164*a* and 164*b* can be defined by geometry or features of the insert portion 134 and/or portions of the housing.

Advantageously, due to the features of the fluidic oscillator 100 described herein, the fluidic oscillator 100 can oscillate, cycle, or vibrate at a lower frequency that certain conventional fluidic oscillators. For example, based on computational fluid dynamics numerical analysis, a fluidic oscillator 100 sized for a flow rate of 3 barrels per minute (126 gallons per minute) can oscillate at 20 Hz. Advantageously, by oscillating at lower frequencies, axial vibrations caused by the fluidic oscillator 100 can travel extended distances (e.g. along a long string of inlet tubing) to vibrate tools effectively.

Figure 6:
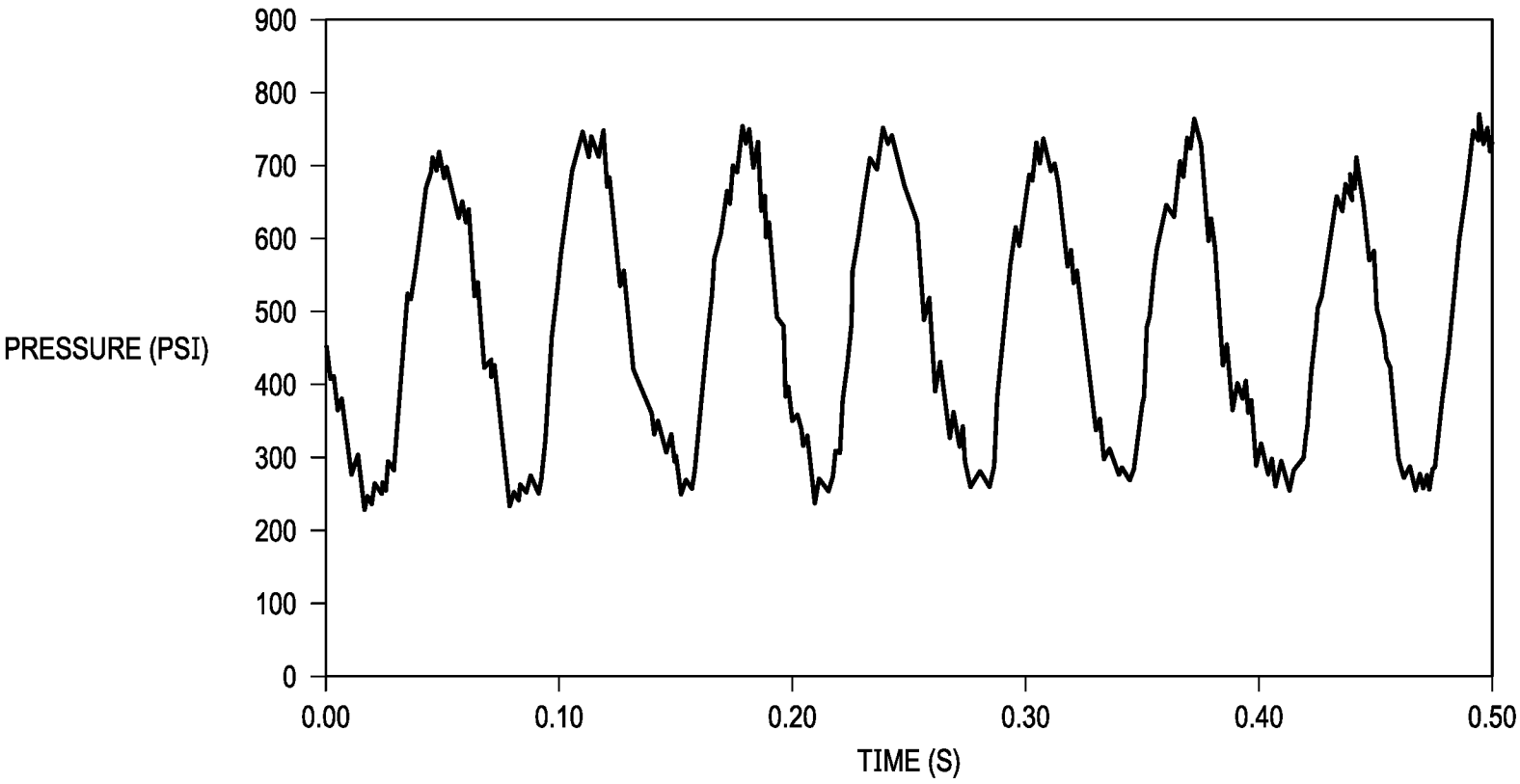
FIG. 6 is a chart illustrating pressure over time for an embodiment of the fluidic oscillator of FIG. 1.

FIG. 6 is a chart illustrating the observed differential pressure over time for an embodiment of the fluidic oscillator 100 of FIG. 1 when water is pumped through it at 2 barrels per minute (84 gallons per minute) As illustrated, fluid pressure within the fluidic oscillator 100 can cyclically increase and decrease, over time, causing cyclical vibrations. As can be appreciated, the fluidic oscillator 100 can oscillate, cycle, or vibrate at a lower frequency than certain conventional fluidic oscillators. For example, based on experimental observations, a fluidic oscillator 100 sized to fit in a 2⅞" housing and for a flow rate of 2 barrels per minute (126 gallons per minute) can oscillate as low as 16 Hz. Advantageously, by oscillating at lower frequencies, axial vibrations caused by the fluidic oscillator 100 can travel extended distances (e.g., along a long string of tubing) to vibrate tools effectively.

Figure 7A:
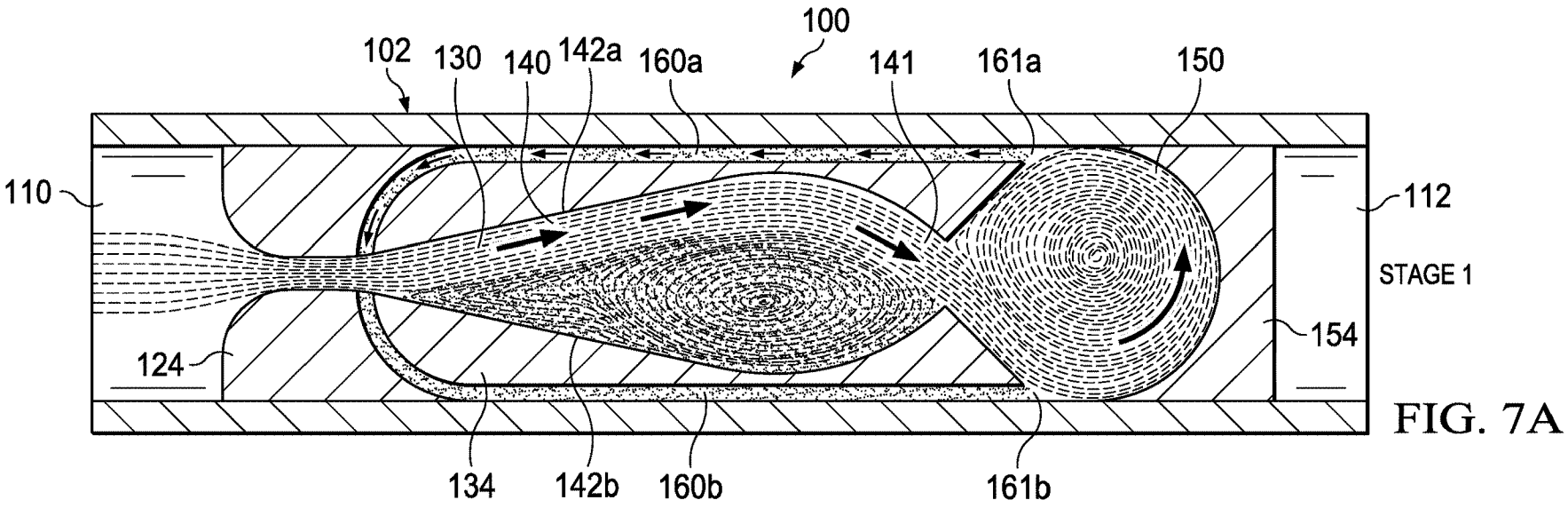
FIGS. 7A-7H are cross-sectional views of the fluidic oscillator of FIG. 1 with arrows illustrating computed flow streamlines over time.

FIGS. 7A-7H are cross-sectional views of the fluidic oscillator 100 of FIG. 1 illustrating computed flow streamlines over time. The lighter areas indicate higher velocity. The superimposed arrows indicate the relative speed and direction of the flow. With reference to FIG. 7A, as flow is directed from the inlet volume 110 and through the nozzle 120 toward the upper wall 142*a*, the flow forms a wall jet that is attached to the upper wall 142*a* and remains parallel to upper wall 143*a* without dissipating. The curvature of wall 143*a* deflects the jet so that it enters the vortex chamber 150 at a tangent and creates a counter-clockwise rotational vortex flow in the vortex chamber 150, creating increased fluid pressure within the fluidic oscillator 100.

Figure 7B:
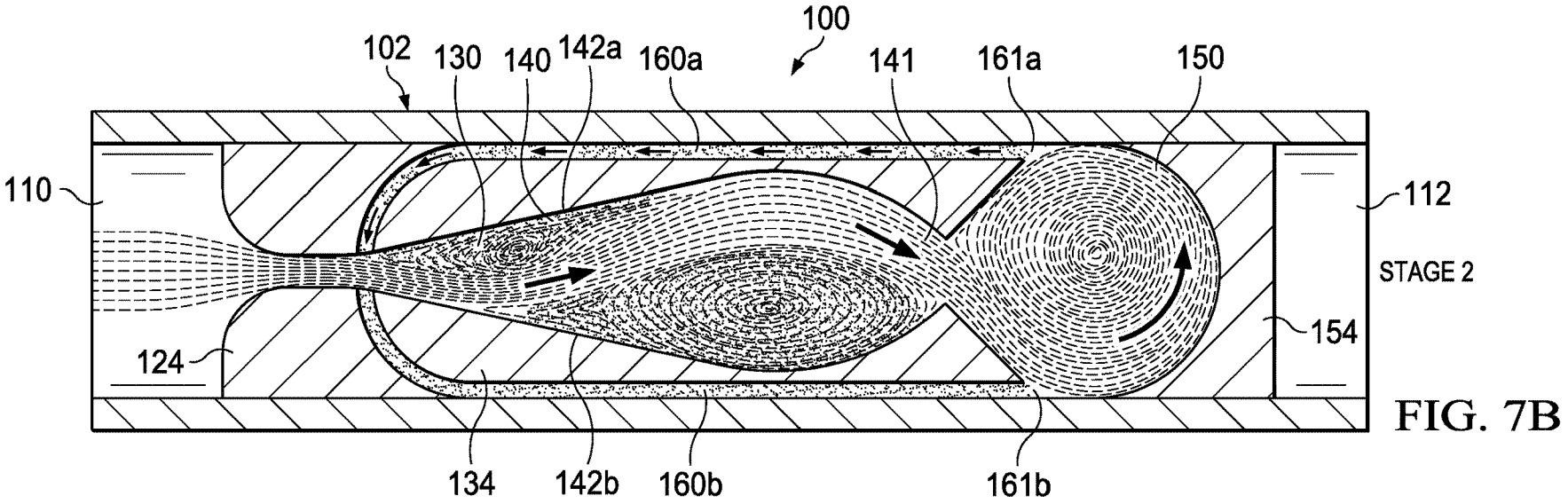
Figure 7C:
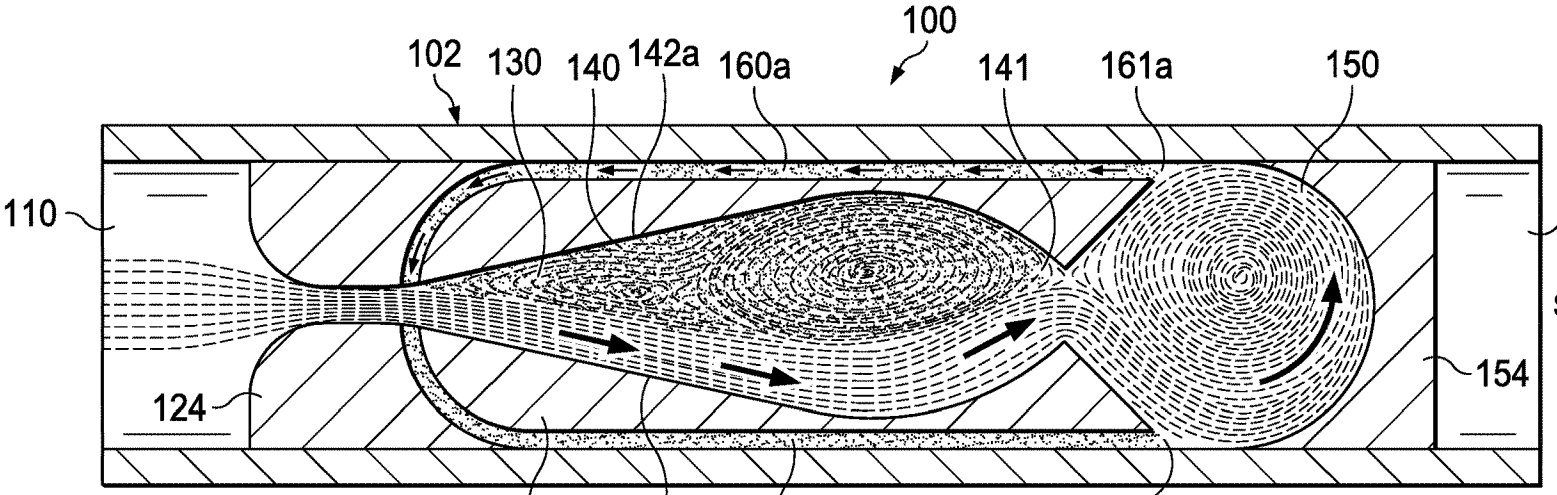
Figure 7D:
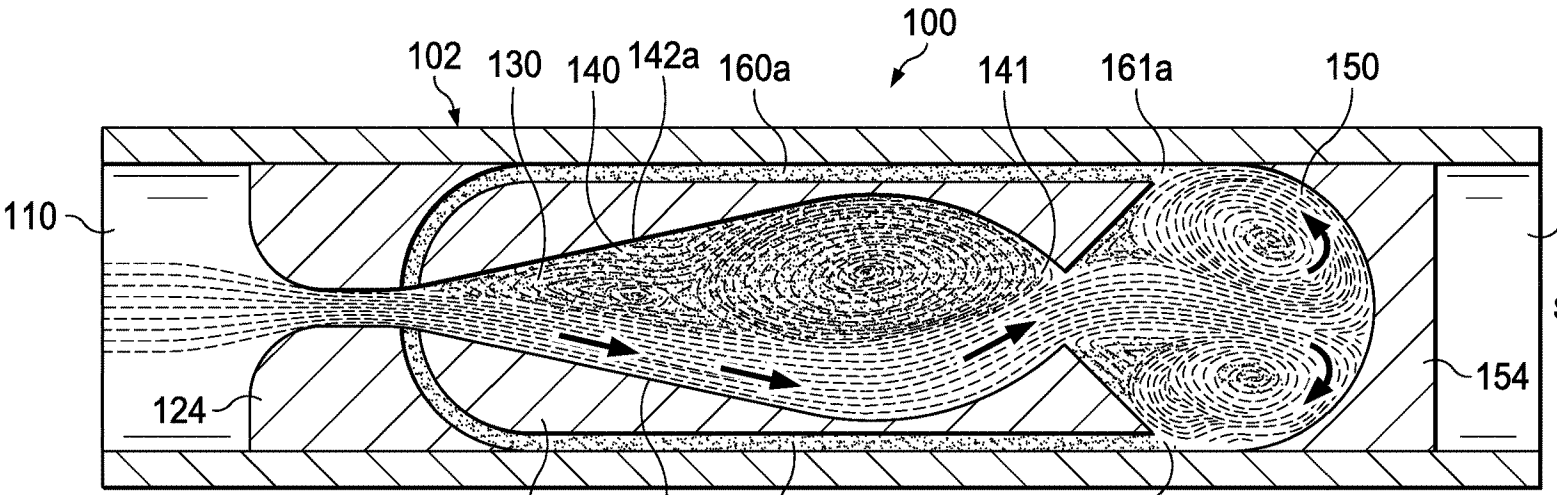

With reference to FIGS. 7B and 7C, the counter-clockwise rotational vortex flow in the vortex chamber 150 creates positive pressure differential across the upper control line 160*a* and the lower control line 160*b*. In FIG. 7B the wall jet has detached from the upper wall 142*a* and is starting to attach to the lower wall 142*b*. The rotational flow in the vortex chamber and the pressure differential though the valve are at their peak. With reference to FIG. 7C, the wall jet is now fully attached to lower wall 142*b* and is opposed to the direction of the vortex, which is starting to weaken. With reference to FIG. 7D the counterclockwise vortex is very weak and a clockwise vortex is starting to form. The pressure differential though the vortex chamber is at a minimum reducing pressure within the fluidic oscillator 100.

Figure 7E:
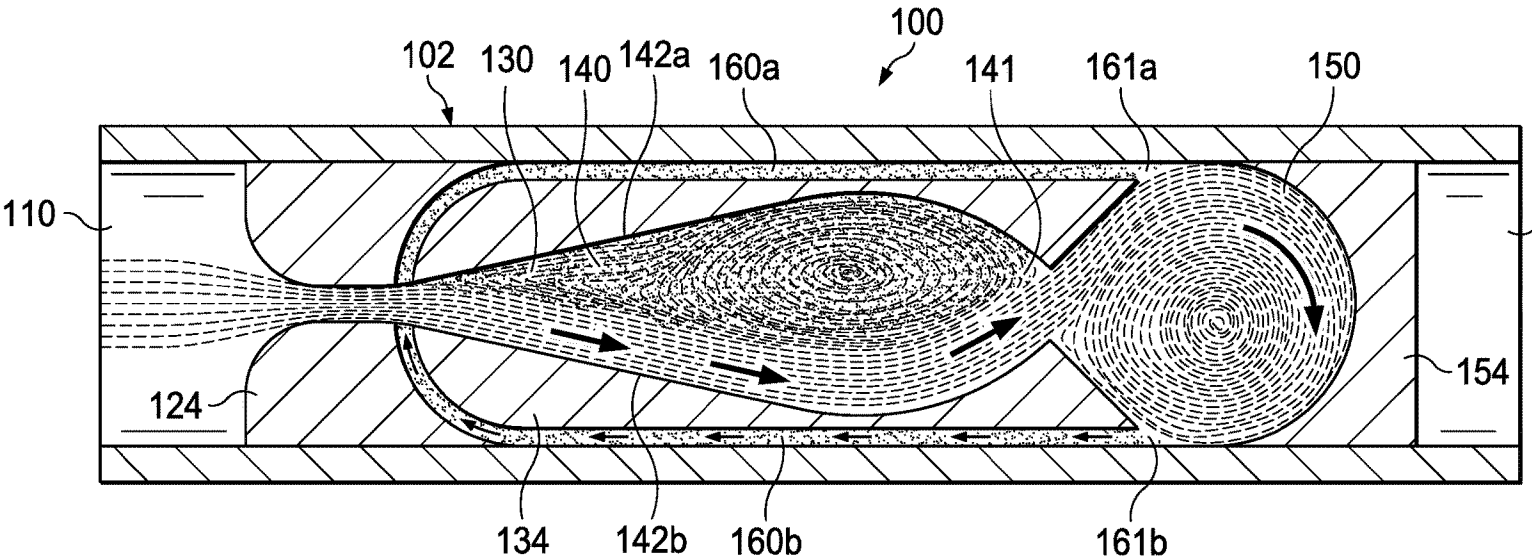
Figure 7F:
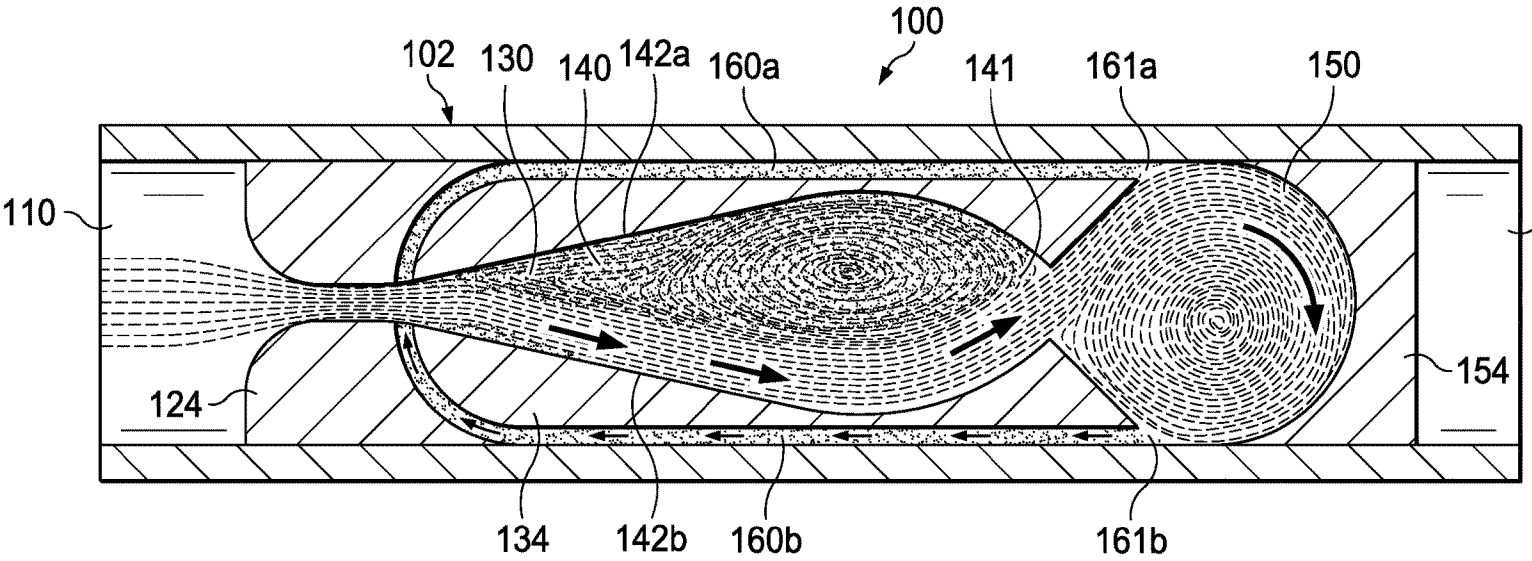
Figure 7G:
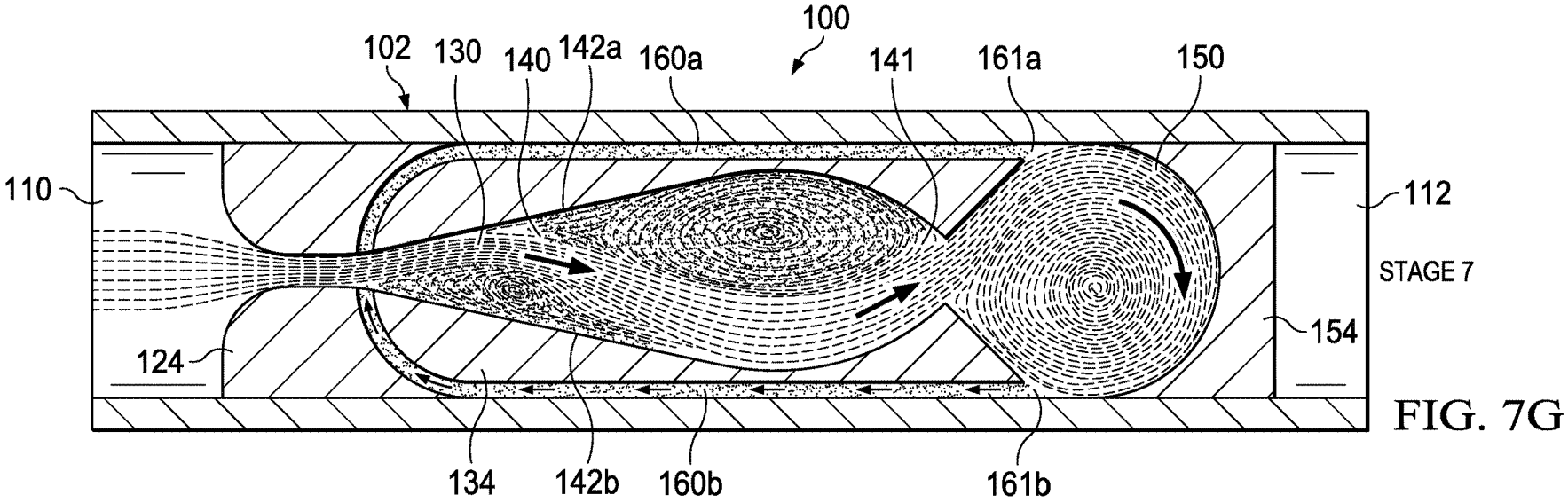
Figure 7H:
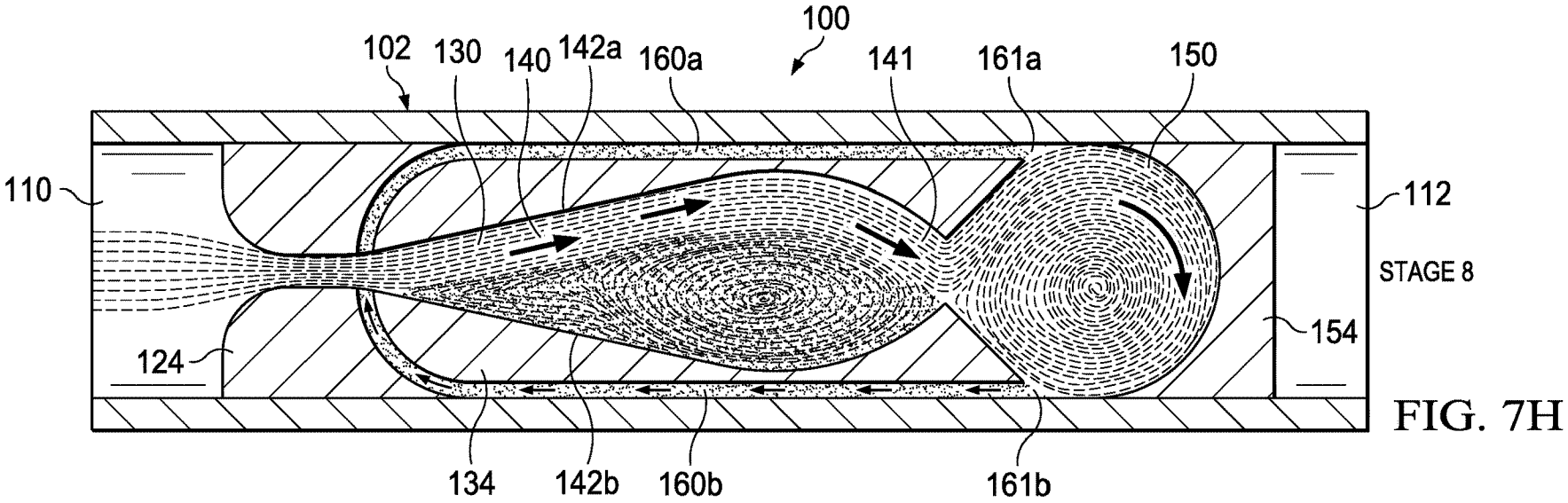

With reference to FIGS. 7E and 7F, flow attached to the lower wall 142*b* forms a clockwise rotational vortex in the vortex chamber 150. With reference to FIG. 7G, clockwise rotational vortex flow in the vortex chamber 150 similarly creates a peak fluid pressure within the fluidic oscillator 100. As can be appreciated, as peak pressure is achieved, the negative pressure differential across the upper control line 160*a* and the lower control line 160*b* begins to cycle the fluid flow back toward the upper wall 142*a*, causing the vortex to start to weaken as illustrated in FIG. 7 H facilitating the oscillation of the fluidic oscillator 100.

Figure 8:
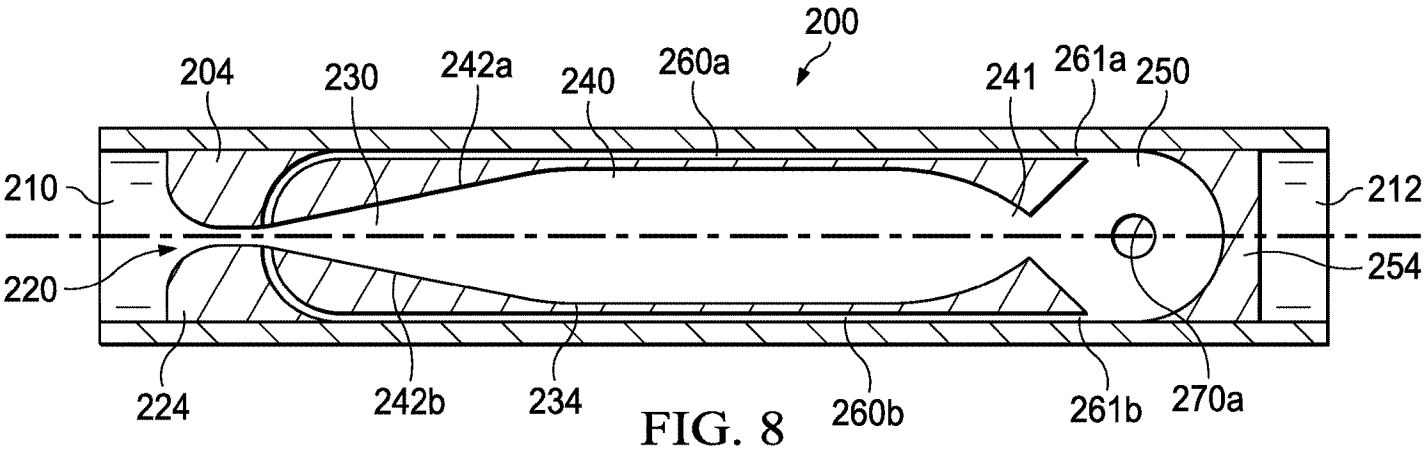
FIG. 8 is cross-sectional view of a fluidic oscillator.

FIG. 8 is a cross-sectional view of a fluidic oscillator 200. In the depicted example, the fluidic oscillator 200 includes features that are similar to the fluidic oscillator 100. Therefore, unless noted, similar features are referred to with similar reference numerals. As illustrated, the fluidic oscillator 200 can utilize an elongated flow volume 240 to reduce the cycle rate of pressure oscillations.

In some embodiments, the flow volume 240 can have an elongated length relative to other dimensions of the fluidic oscillator 200, such as the width of the nozzle 220. For example, the ratio between the length of flow volume 240 to the width of the nozzle 220 can be any ratio between 10:1, and 30:1, etc. Preferably, the ratio between the length of flow volume 240 to the width of the nozzle 220 is approximately 18:1, as it has been determined that such a ratio provides optimal performance and control of the cycle rate. Optionally, the flow volume 240 can be elongated relative to the vortex chamber 250. As can be appreciated, the control lines 260*a* and 260*b* can have a similar elongated ratio.

Figure 9:
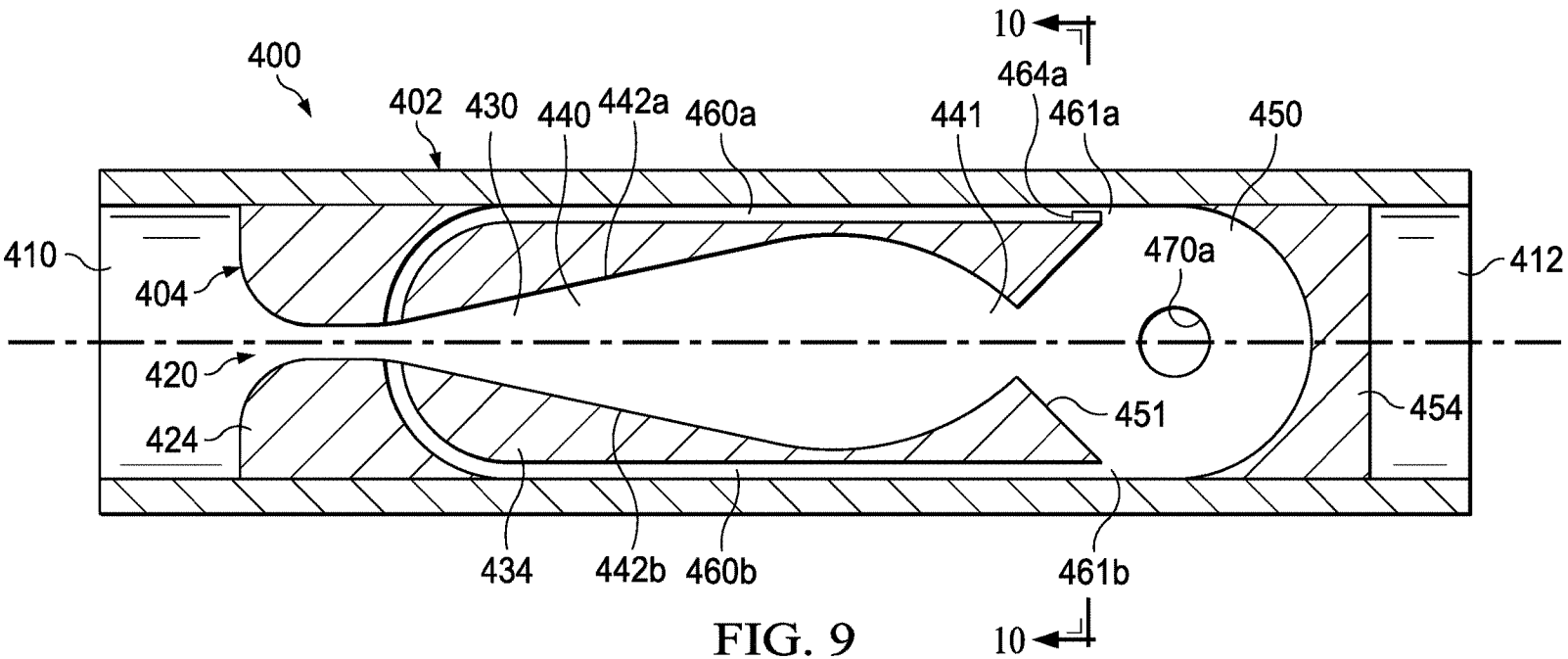
FIG. 9 is a cross-sectional view of a fluidic oscillator.
Figure 10:
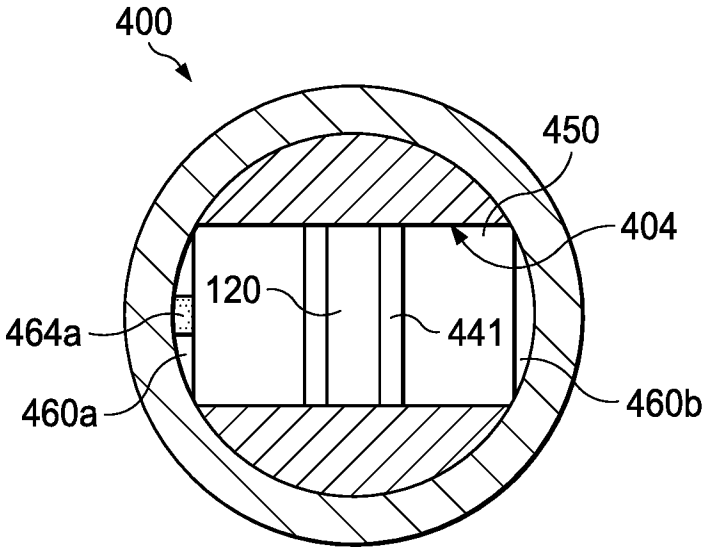
FIG. 10 is a cross-sectional view of the fluidic oscillator of FIG. 9 at section line 10-10.

FIG. 9 is a cross-sectional view of a fluidic oscillator 400. FIG. 10 is a cross-sectional view of the fluidic oscillator of FIG. 9 at section line 10-10. With reference to FIGS. 9 and 10, the fluidic oscillator 400 includes features that are similar to the fluidic oscillator 100. Therefore, unless noted, similar features are referred to with similar reference numerals. As illustrated, the fluidic oscillator 400 can utilize a single restrictor 464*a* to reduce the cycle rate of pressure oscillations. The restrictor 464*a* can be a central body restrictor as shown in FIG. 10.

In some embodiments, one of the control lines 460*a* or 460*b* can include a restrictor 464*a* disposed along the flow path defined by the control line 460*a* or 460*b*. As illustrated, the control line 460*a* can include the single restrictor 464*a*. During operation, the single restrictor 464*a* disposed in the control line 460*a* of the fluidic oscillator 400 can allow for counterclockwise vortex flow to generate a high amplitude pressure pulse while the clockwise vortex flow generates a lower amplitude pressure pulse.

As can be appreciated, a single restrictor may be included in either control line 460*a* or 460*b*. A single restrictor disposed in the control line 460*b* of the fluidic oscillator 400 can allow for clockwise vortex flow to generate a high amplitude pressure pulse while the counterclockwise vortex flow generates a lower amplitude pressure pulse.

As described herein the restrictor 464*a* can be disposed adjacent to a respective control port 461*a* or 461*b* and/or the vortex chamber 450. In some embodiments, the restrictor 464*a* can be disposed adjacent to the switch volume 430 and opposite to the vortex chamber 450. Advantageously, the use of single restrictor 464*a* can operate at substantially lower differential pressure and frequency than conventional devices.

Figure 11:
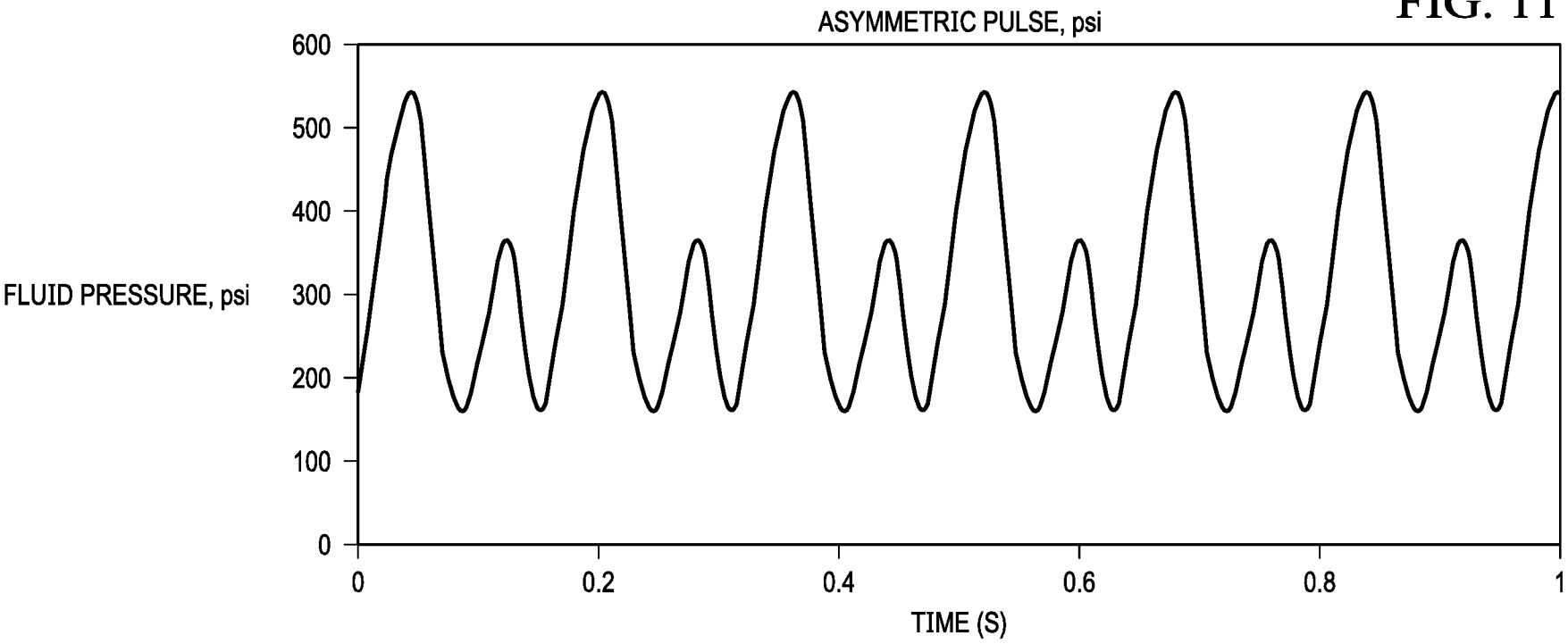
FIG. 11 is a chart illustrating a computed asymmetric pulse profile for an embodiment of the fluidic oscillator of FIG. 9.

FIG. 11 is a chart illustrating an asymmetric pulse profile for an embodiment of the fluidic oscillator 400 of FIG. 9. As illustrated, fluid pressure within the fluidic oscillator 400 can cyclically increase and decrease, over time, causing cyclical vibrations. Due to the use of the single restrictor 464*a*, the fluidic oscillator 400 can generate higher amplitude pressure pulses and lower amplitude pressure pulses as the fluidic oscillator 400 cycles, creating the asymmetric pulse profile shown in FIG. 11. Advantageously, the asymmetric pulse profile created by the fluidic oscillator 400 can reduce the load required to move a long length of tubing by 25% compared to a conventional fluidic oscillator that utilizes a constant frequency pulse with the same peak-peak amplitude.

As illustrated, the average differential pressure through the fluidic oscillator 400 is approximately 320 psid, compared to the typical 500-700 psid required to operate conventional fluidic oscillators at the same flow rate. Advantageously, by utilizing a lower average differential pressure, the fluidic oscillator 400 can introduce a lower frequency component to the pulses and allows operation at lower differential pressures while increasing pulse effectiveness. Further, the asymmetric pulse profile created by the fluidic oscillator 400 can decrease the pressure required to operate the fluidic oscillator 400 by 10% compared to a conventional fluidic oscillator.

Figure 12:
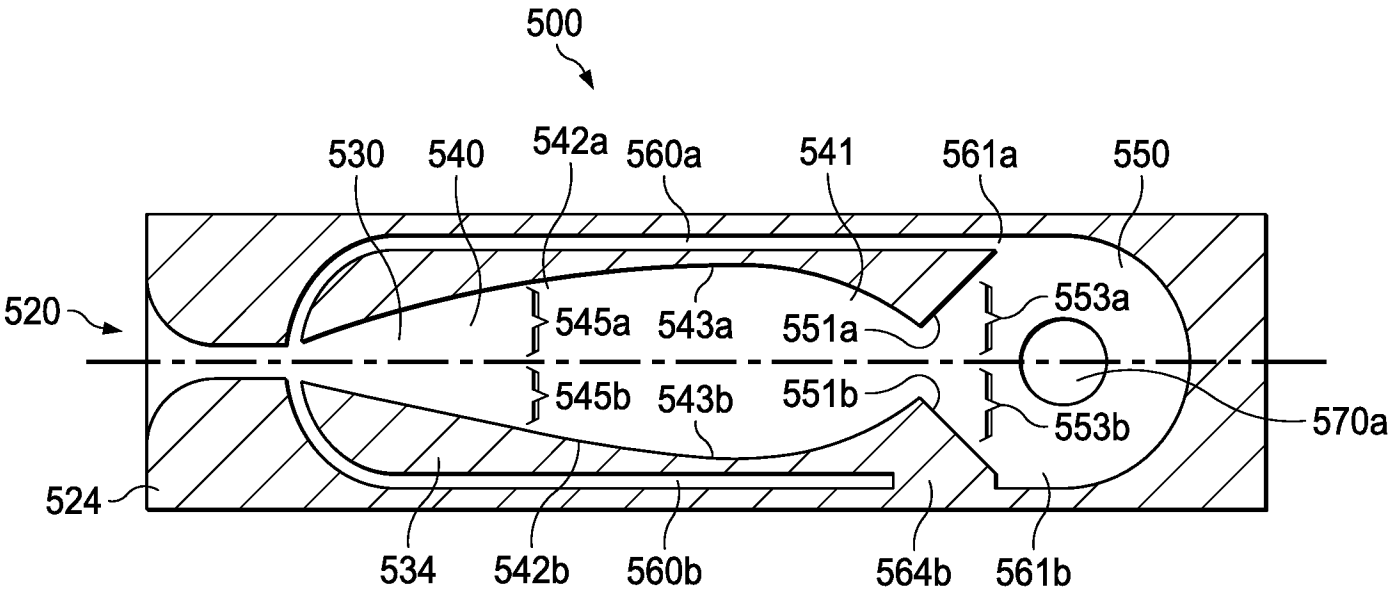
FIG. 12 is a cross-sectional view of a fluidic oscillator.

FIG. 12 is a cross-sectional view of a fluidic oscillator 500. In the depicted example, the fluidic oscillator 500 includes features that are similar to the fluidic oscillator 100. Therefore, unless noted, similar features are referred to with similar reference numerals. As illustrated, the fluidic oscillator 500 can utilize a single restrictor 564*b* disposed along the flow path defined by the control line 560*b*. The restrictor 564*b* can be a central body restrictor.

As described herein, the angle 545*a* between the upper wall 542*a* and the centerline of the device and/or the angle 545*b* between the lower wall 542*b* and the centerline of the device can be different. For example, the upper wall angle 545*a* can be 20 degrees and the lower wall angle 545*b* can be 12 degrees.

Figure 13:
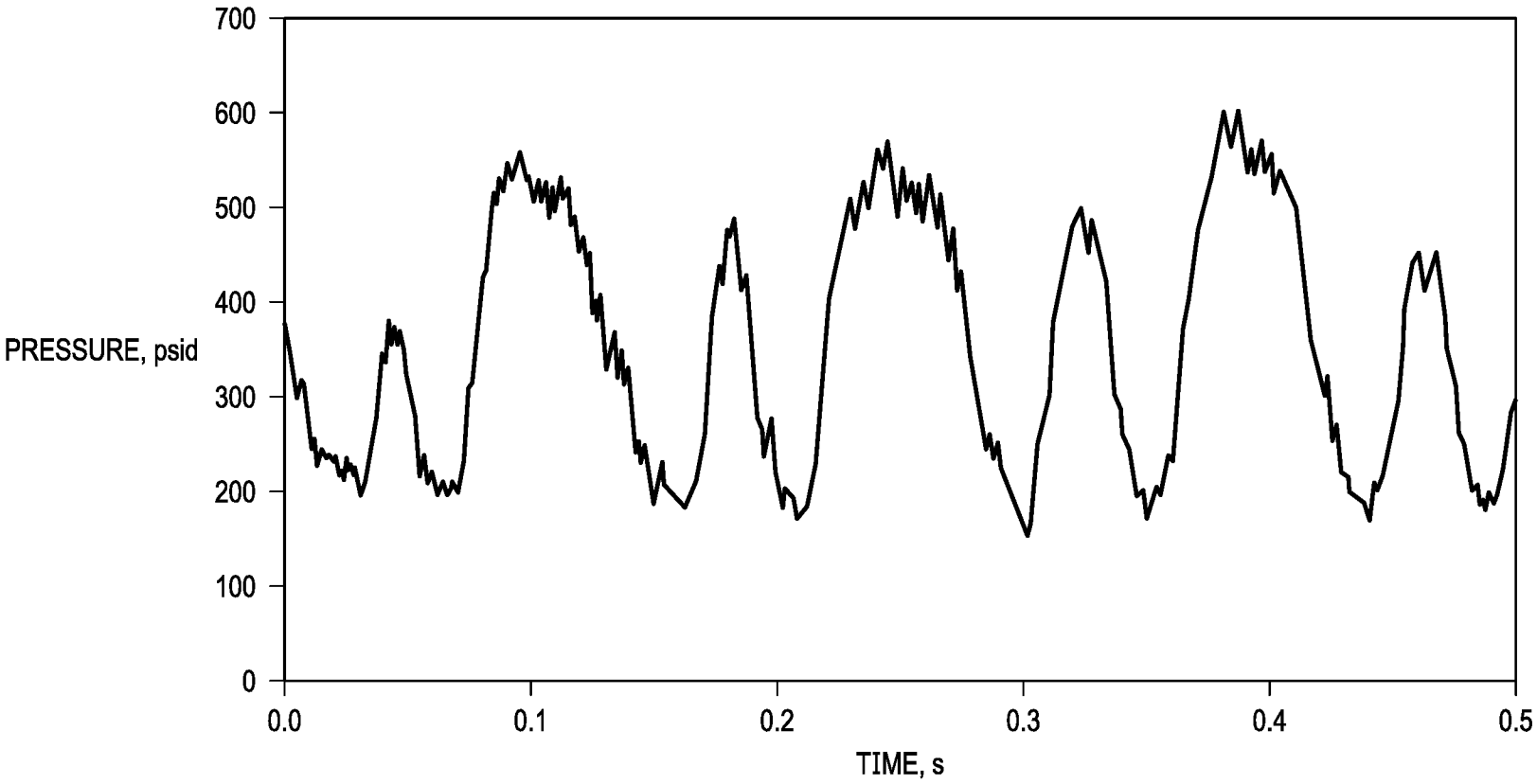
FIG. 13 is a chart illustrating an observed asymmetric pulse profile for an embodiment of the fluidic oscillator of FIG. 12.

FIG. 13 is a chart illustrating an observed asymmetric pulse profile for an embodiment of the fluidic oscillator 500 of FIG. 12. With reference to FIGS. 12 and 13, during operation, flow can be more strongly attached to the 12 degree lower wall 542*b*, and flow restriction 564*b* is in place which results in a strong pulse with relatively long duration. After switching, the wall jet is weakly attached to the upper wall 542*a*, and the control passage 561*a* is not restricted resulting in a relatively short, low amplitude pulse as shown in FIG. 14. Advantageously, this pulse profile provides significantly improved extended reach capability because the frequency of the large pulses is reduced and the mean pressure differential is lower than a symmetric pulse. For example, the frequency of the large pulses can be reduced to 6 Hz.

It is understood that variations may be made in the foregoing without departing from the scope of the present disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A fluidic oscillator, comprising:

an inlet;

an outlet;

a vortex chamber in fluid communication with the outlet, a single flow volume in fluid communication with the inlet and the vortex chamber, and defined by a first wall and a second wall;

a first control port and a second control port, each disposed tangentially to a wall of the vortex chamber;

a first control line in fluid communication with the first control port; and a second control line in fluid communication with the second control port, wherein the first control line and the second control line are configured to direct a fluid flow from the inlet to the vortex chamber toward the first wall and the second wall, respectively, and the first wall and the second wall are configured to direct the fluid flow to create a vortex flow in the vortex chamber.

2. The fluidic oscillator of claim 1 wherein at least one of the first control port and the second control port comprises a flow restrictor proximate to the vortex chamber.

3. The fluidic oscillator of claim 2, wherein the flow restrictor comprises a central body restrictor.

4. The fluidic oscillator of claim 1, the first wall comprising a first wall angle, the second wall comprising a second wall angle, wherein the first wall angle and the second wall angle are different.

5. The fluidic oscillator of claim 1, configured such that the fluid flow alternately cycles between the first wall and the second wall and the rate of such cycling is equal to or less than 20 Hz.

6. The fluidic oscillator of claim 1, wherein the first control line and the second control line each include a flow restrictor to reduce a respective cross-sectional area of the first control line and the second control line adjacent to the first control port and the second control port.

7. The fluidic oscillator of claim 1, wherein the first control line includes a flow restrictor to reduce a cross-sectional area of the first control line.

8. The fluidic oscillator of claim 1, wherein the second control line includes a flow restrictor to reduce a cross-sectional area of the second control line.

9. A fluidic oscillator, comprising:

a tubular housing defining an inlet volume and an outlet volume;

a single flow volume in fluid communication with the inlet volume, the flow volume defined by a first wall and a second wall;

a vortex chamber in fluid communication with the flow volume, wherein the first wall and the second wall are arranged to direct a fluid flow from the inlet volume to create a vortex flow in the vortex chamber tangential to the first wall and the second wall, wherein the vortex flow is in fluid communication with the outlet volume; and a first control line and a second control line in fluid communication with the vortex chamber at a first control port and a second control port, respectively, wherein the first control line and the second control line are each disposed tangentially to a wall of the vortex chamber, and configured to direct the fluid flow toward the first wall and the second wall respectively.

10. The fluidic oscillator of claim 9, further comprising:

a nozzle in fluid communication with the inlet volume, the nozzle having nozzle height that has a nozzle ratio of 2:1 to 5:1 relative to a nozzle width, wherein the nozzle converges to accelerate the fluid flow into the flow volume.

11. The fluidic oscillator of claim 10, wherein the flow volume has a volume length that has a length ratio of 10:1 to 40:1 relative to the nozzle width.

12. The fluidic oscillator of claim 9, wherein the vortex chamber comprises at least one axial exit port in fluid communication with the outlet volume, the at least one axial exit port having a port diameter that is 3 to 10 times smaller than a diameter of the vortex chamber.

13. The fluidic oscillator of claim 9, wherein at least one of the first control port and the second control port are spaced apart at the vortex chamber.

14. The fluidic oscillator of claim 9, the first wall comprising a first wall angle, the second wall comprising a second wall angle, wherein the first wall angle and the second wall angle are different.

15. The fluidic oscillator of claim 9, configured such that the fluid flow alternately cycles between the first wall and the second wall and the rate of such cycling is equal to or less than 20 Hz.

16. The fluidic oscillator of claim 9, wherein the first control line and the second control line each include a flow restrictor to reduce a respective cross-sectional area of the first control line and the second control line adjacent to the first control port and the second control port.

17. The fluidic oscillator of claim 9, wherein the first control line includes a flow restrictor to reduce a cross-sectional area of the first control line.

18. The fluidic oscillator of claim 9, wherein the second control line includes a flow restrictor to reduce a cross-sectional area of the second control line.

19. The fluidic oscillator of claim 9, wherein the vortex chamber comprises an upper chamber wall disposed adjacent to the flow volume and the upper chamber wall is angled relative to the tubular housing.

20. A method comprising:

directing a fluid flow into a single flow volume comprising a first wall and a second wall, such that the flow forms a wall jet attached to one of the first wall or the second wall;

creating in a vortex chamber a vortex flow tangential to the first wall and the second wall by directing the wall jet from the single flow volume to the vortex chamber;

directing the vortex flow tangentially past a first control port and a second control port;

creating a pressure differential across the first control port and the second control port; and cycling the attachment of the wall jet between the first wall and the second wall at a cycle rate in response to the pressure differential.

21. The method of claim 20, further comprising:

directing the fluid flow between the first wall and the second wall at the cycle rate.

22. The method of claim 20, further comprising:

directing the fluid flow from the first wall to create the vortex flow in a first rotational direction.

23. The method of claim 22, further comprising:

impinging the vortex flow on the first control port; and flowing the vortex flow across the second control port.

24. The method of claim 22, further comprising:

directing the fluid flow toward the second wall in response to the pressure differential.

25. The method of claim 20, further comprising:

directing the fluid flow from the second wall to create the vortex flow in a second rotational direction.

26. The method of claim 25, further comprising:

impinging the vortex flow on the second control port; and flowing the vortex flow across the first control port.

27. The method of claim 25, further comprising:

directing the fluid flow toward the first wall in response to the pressure differential.

28. The method of claim 20, further comprising:

directing the pressure differential across the first control port and the second control port toward the fluid flow to direct the fluid flow toward the first wall and the second wall via a first control line and a second control line.

* * * * *